United States Patent [19]

Maximoff et al.

[11] 3,937,553

[45] Feb. 10, 1976

[54] ELECTRICAL TERMINAL CONNECTOR

[75] Inventors: Paul A. Maximoff, Schaumberg; Albert P. DeVito, Glenview, both of Ill.

[73] Assignee: Palmer Industries Ltd., Chicago, Ill.

[22] Filed: Nov. 13, 1974

[21] Appl. No.: 523,318

[52] U.S. Cl. ..... 339/258 R; 339/275 B

[51] Int. Cl.[2] ..... H01R 13/12

[58] Field of Search ..... 339/217, 220, 258, 275

[56] References Cited

UNITED STATES PATENTS

| | | | |
|---|---|---|---|
| 3,479,634 | 11/1969 | Pritulsky | 339/275 B |
| 3,510,831 | 5/1970 | DeVito | 339/275 B |
| 3,796,988 | 3/1974 | Palombella | 339/275 B |

*Primary Examiner*—Joseph H. McGlynn

*Attorney, Agent, or Firm*—Leo J. Aubel; Robert E. Wagner; Gerald T. Shekleton

[57] ABSTRACT

An electrical terminal connector for inserting or snapping into a mounted position on a printed circuit board to be securely retained therein, with the connector being adapted to receive a plurality of electrical leads and having tines or leads for engaging and securely holding the leads in the connector.

5 Claims, 10 Drawing Figures

FIG. 1
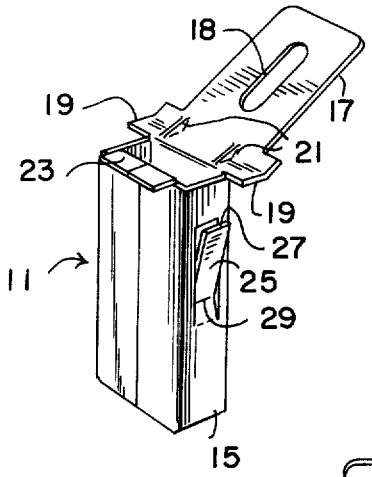
FIG. 2
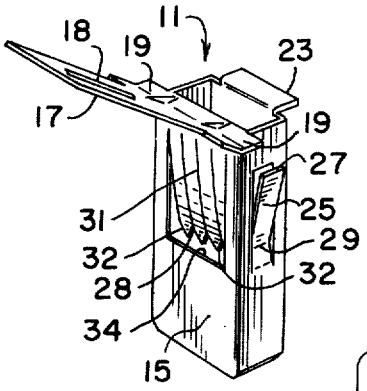
FIG. 3
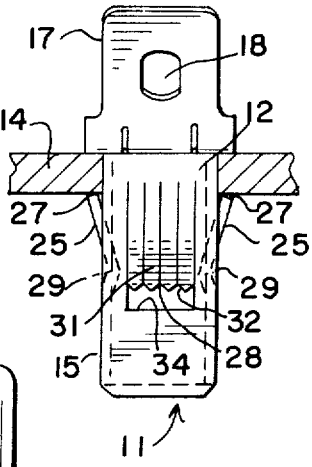
FIG. 4
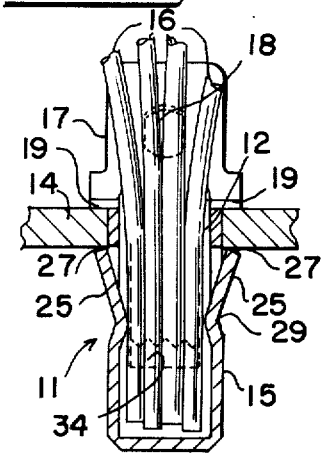
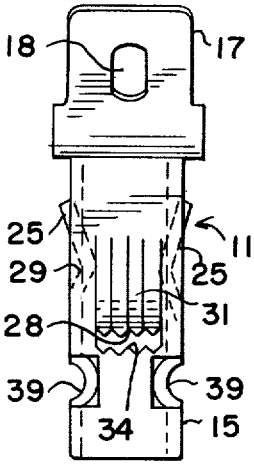
FIG. 5
FIG. 6
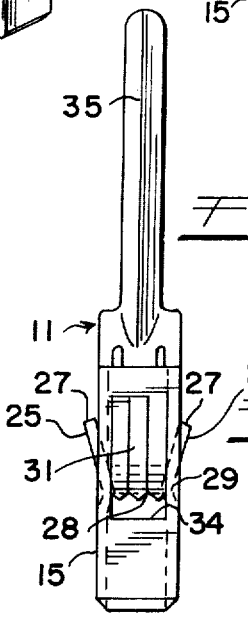
FIG. 8
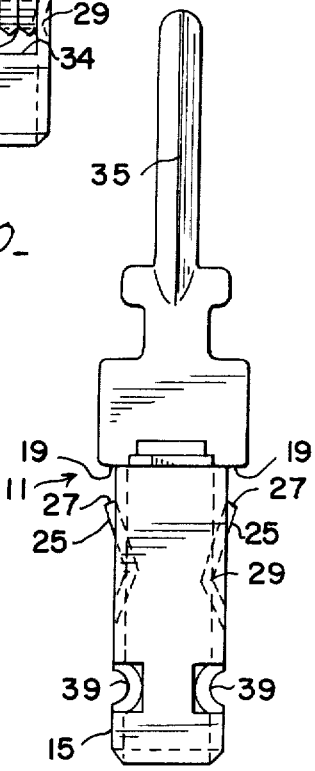
FIG. 10
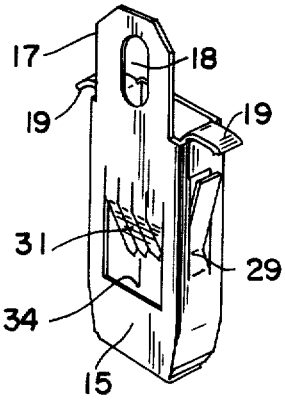
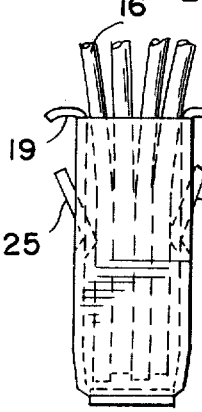
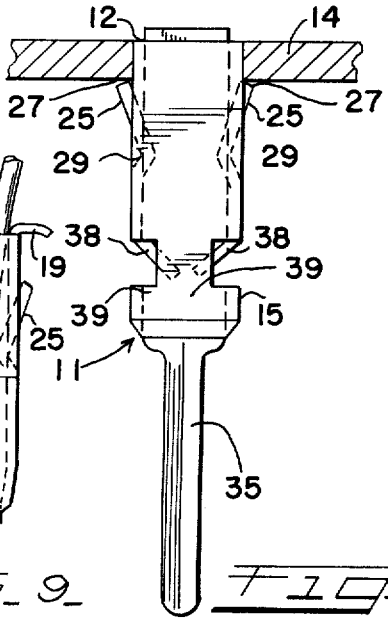
FIG. 9
FIG. 7

ELECTRICAL TERMINAL CONNECTOR

BACKGROUND OF THE INVENTION

As is well known in the terminal connector art, various structures and expedients have been utilized to mount and retain electrical terminal connectors on the associated bases. Among such structures are screws, rivets, sliding connectors, and clamps or clips of one sort or another. With the advent and now wide spread use of printed circuits, and hence, of printed circuit boards, the need has arisen for providing improved terminals for connecting electrical wires or leads for circuit boards.

Accordingly, the present invention is directed to providing an improved electrical terminal connector particularly suited for use with, or on printed circuit boards (but not necessarily limited thereto), which terminal is adapted to receive from one to five electrical leads or wires of various gauge sizes with the wires being of either stranded or solid construction.

Tines or leaves are formed and positioned in the terminal connector to securely engage the wires inserted therein and windows or openings are formed in the body of the terminal to assure that a path for solder is provided to insure firm mechanical connection and electrical connection between the wires and the terminal connector.

The inventive terminal connector may be either manually or automatically inserted or mounted in the associated apertures of the printed circuit board. After insertion of the terminal in the associated boards, the terminal is securely retained therein by a unique lug constructions which permits the inventive connector to adapt to and be firmly mounted on printed circuit boards of varying thicknesses.

More specifically, the terminal connector includes flexible lugs which are readily adjustable after insertion of the terminal connector into the printed circuit boards to cause the lug to firmly abut and engage the surface of the printed board to provide a firm mechanical mounting for the terminal connector.

The foregoing and other features and advantages of the invention will be apparent from the following more particular description of the preferred embodiments of the invention, as illustrated in the accompanying drawings wherein:

DESCRIPTION OF THE DRAWINGS

FIG. 1 is an isometric relatively front view of the inventive terminal connector;

FIG. 2 is an isometric view of the inventive terminal connector showing a relatively opposite or reverse side to that shown in FIG. 1;

FIG. 3 is a frontal elevational view of the inventive terminal connector mounted in a printed circuit board to more clearly show the construction of the angled resilient arms;

FIG. 4 is a view partially in cross section showing the terminal connector mounted in a printed circuit board and wires inserted in the connector;

FIG. 5 shows a modification of the terminal connector of FIGS. 1–4;

FIG. 6 is a frontal elevational view of another embodiment of the inventive terminal connector;

FIG. 7 is a frontal elevational view of another embodiment of the inventive terminal connector; and, FIG. 8 is a frontal elevational view of still another embodiment of the inventive terminal connector mounted in a printed circuit board.

FIG. 9 is a view of still another embodiment of the present invention partially in cross section showing the terminal connector with wires inserted in the connector;

FIG. 10 is an isometric view showing the reverse side of still another embodiment of the present invention.

DESCRIPTION OF THE INVENTION

Refer first to FIG. 4 which shows the inventive terminal connector 11 mounted in an associated aperture 12 in a printed circuit board 14. In a preferred embodiment, the terminal connector 11 comprises a substantially rigid body of a relatively rectangular and tubular cross section. The aperture 12 is of a size and shape to accommodate the terminal connector 11.

As indicated in FIG. 4, the terminal connector 11 is arranged to receive one or more electrical lead wires 16 connecting to the associated electrical circuitry.

Connector 11 includes an elongated tubular body or well portion 15 having an open upper end for receiving the electrical lead wires 16, and a closed lower end for retaining the solder when the lead wires 16 are being soldered to the terminal connector 11 as will be explained. The connector 11 may be formed of pre-tinned brass or pre-tinned steel and is not limited to any particular size.

As seen in FIG. 1, a solder lug 17 extends upwardly and at an angle from a horizontal flange 19 which in turn extends from the broad back side of the well portion 15 and includes an aperture 18 for receiving an electrical wire. Horizontal flange 19 extends from the upper open end of the back side of the well portion. Flange 19 is relatively wider than the broad side of the well portion 15 and is adapted to rest on the upper surface of the printed circuit board 14 when connector 11 is mounted thereon. Buttress ribs 21 are formed between the flat flange 19 and the angled solder lug 17 for strengthening purposes.

A second horizontal flange 23 extends from the upper end of the front side of the well portion 15 and is also adapted to rest on the upper side of the printed circuit board 14 when connector 11 is mounted thereon.

Resilient arms, generally labeled 25, are formed on the narrow sides of the body portion 15; see FIG. 3. The arms 25 are formed integrally with the body portion and are struck from, or severed and pushed outwardly from, the narrow sides of the body portion 15 to form cantilevered resilient members. The arms 25 project upwardly and outwardly at an angle beyond the side of the rectangular tubular body, and the upper tip 27 of each of the arms 25 is arranged to engage the lower surface of the printed circuit board 14 as shown in FIG. 4.

The spacing between the lower surface of the flanges 23 and 19 and the tips 27 of the angled arms 25 is arranged so as to accomodate a printed circuit board 14 of a given maximum thickness. Elbows or bends 29 are formed in the arms 25 and intermediate the ends of the arms, the elbows 29 are bent inwardly and the apex of the elbows lies within the interior of the rectangular tubular body portion 15.

The construction of the arms 25 including the elbows 29 permits the arms to be adjusted to adapt the terminal connector 11 to accomodate to printed circuit boards of various thicknesses. More specifically, to securely affix the terminal connector 11 to the printed circuit board 14, the lower tubular portion 15 of connector 11 is first pushed through the aperture 12 past the angled arms 25 and the tips 27 of the arms. If the printed circuit board is of a given thickness, the spacing between the tips 27 of arms 25 and the flanges 23 and 19 is such that as the printed circuit boards 15 clear the tip of the arm 25, the upper surface of the printed circuit board 14 will engage the flanges 21 and 23 to securely position the terminal connector 11 in the board. If the circuit board 14 is of a lesser thickness than the spacing between tips 27 and flanges 19 and 23, there will be a slight give or play of the terminal connector 11 in the aperture 12. To securely affix the terminal connector 11 in the aperture 12 of printed circuit board 14, a selected tool of suitable design (not shown) is forced into the terminal connector body portion 15 to push or urge the elbows 29 of arms 25 outwardly. The foregoing operation causes the upper ends or tips 27 of the arms 25 to move upwardly to abut firmly against the lower surface of the printed circuit board 14 and thereby securely fasten the terminal connector 11 in position.

Resilient tines or fingers 31 are integrally formed in the well portion 15 for gripping the electrical wires of the various types and sizes which are inserted into the terminal connector 11. The tines or fingers 31 are formed by striking or severing a portion of the back broad side of the well portion 15 and bending the struck portion in cantilever fashion toward the opposite or front side of the well portion. Slits 28 are cut in the struck portion to form the tines or fingers 31, as can be better appreciated in FIG. 2. The tines 31 extend downwardly into the well portion 15 in angled cantilever fashion with the lower ends 32 of the tines being contiguous with the planar interior surface of the front side of the well portion 15. The lower ends of tips 32 of the tines are angled or sharpened to better engage since the tines 31 are resiliently arranged to extend in angled relation toward the front side of the well portion, when a lead wire 16 is inserted into the well portion 15, the sharpened end 32 of tines 31 bear against and grip the wire 16 to tend to hold the wire in position.

As mentioned, tines 31 are separated along their length and are bent inwardly at an angle against the opposing surface of the well portion 15. Each of the tines 31 functions as a separate resilient member to provide a distinct separate pressure to the wires 16 pushed into the well portion 15. Thus, various wires, even wires of different diameters, can be inserted into the terminal connector well portion 15 and each tine 31 will still provide pressure and hence a gripping action to wires positioned thereagainst since each of the tines 31 operates as a distinct resilient member.

A window or opening 34 is formed by the operation of striking the back portion of the body to form the tines on one side of the body to assure that solder flows into the interior of well portion 15 to assure that a proper solder connection is made to the wires 16 inserted therein.

When the leads have been inserted in the terminal connector 11 they will remain firmly in the connector even though the printed circuit board 14 may be subjected to rough handling during subsequent operations.

The well portion 15 is closed at the bottom end and provides a stop for the lead wire 16 thereby insuring uniformity of location of the lead wires. Normally, the printed circuit boards 14 with terminal connectors 11 secured thereto are solder dipped. In such operation, the terminal connectors 11 with inserted leads 16 have their well portions 15 dipped into a bath of molten solder, and the molten solder flows freely into the well through the window 34, to provide a permanent bond between the leads 16 and the terminal connector 11.

Another embodiment of the invention is shown in FIG. 5 which employs additional solder openings 39 to provide more convenient access for the solder to penetrate when dipped into the solder bath. The remainder of the terminal connector corresponds to that previously described and shown in FIG. 1.

Other embodiments of the invention employ a wire wrap shank as shown in FIGS. 6, 7 and 8, replacing the solder lug of FIG. 1. FIG. 6 shows a particular embodiment of this type with the lower portion being substantially as shown in FIG. 1 with a slightly different shaped flange than previously described and shown in FIG. 1 and the upper portion substituting a sculptured shank or projection 35 for the solder lug 17. This projection extends straight up and functions as a post for securing wire in a winding or wrap-around manner. The sculpturing feature lends the quality of higher strength to the projection in the same manner as the buttress ribs 21 shown in FIG. 1.

FIG. 7 shows a different version of the embodiment of FIG. 6, whereby the wire wrap shank or projection 35 is disposed on the bottom end of the connector body with resilient arms 25 having a lower portion 38 not present on the embodiments previously discussed in, for example, FIG. 1 or FIG. 5. These lower ends 38 are extended inwardly by severing them from the base and bending them until they come together to form a stop for the wires. Thus it serves the same function as the well portion 15, while allowing additional openings for solder entrance similar to those of FIG. 5.

The embodiment shown in FIG. 8 is essentially a combination of the version of the invention shown in FIG. 6 with the added solder openings shown in FIG. 5.

FIG. 9 shows an embodiment of the present invention which serves generally as a receptacle and contact point for wires 16. This embodiment eliminates the solder lug 17 while still retaining the function of a contact point. In so doing, the surface of the printed circuit board maintains a cleaner appearance without a loss of function.

FIG. 10 shows a version of the present invention substantially similar to FIG. 1, whereby the solder lug 17 points straight up from the solder wall portion 15 and the printed circuit board when in position. By the use of this design, a wire may approach the solder lug from any direction and still be coveniently attached.

Upon consideration of the foregoing, it will become obvious to those skilled in the art that various modifications may be made without departing from the invention embodied herein. Therefore, only such limitations should be imposed as are indicated by the spirit and scope of the appended claims.

What is claimed is:

1. A terminal connector for securing electrical lead wires to a base board having opposite surfaces and having apertures extending through the body for accommodating the connector, the connector comprising, a hollow body substantially in rectangular tubular form having opposing sides and ends, the body being open at one end thereof for receiving wires and a substantially closed opposite end to provide a stop for wires, a plurality of gripping tines positioned substantially on a same plane extending from a side surface of the rectangular body and extending in converging cantilever relation toward the opposite side surface and away from the opening, the converging ends of the tines positioned adjacent the opposite side surface to firmly engage wires inserted into said body, flanges extending from the body arranged to engage one surface of the base board adjacent the aperture to position the terminal connector, resilient cantilever lugs each having an end affixed to said body and the opposite end extending outwardly from said body toward the flanges to engage with the opposite surface of the base, the lugs each having an elbow portion extending into the interior of the body, which elbow portion is capable of being pushed outwardly and upwardly from the interior of the body and thereby urge said outwardly and upwardly extending end of the lugs to firmly abut and engage base boards of varying thicknesses.

2. A terminal connector as in claim 1 wherein the tines are formed in parallel relation, substantially in a plane, and are positioned closely adjacent each other and have their converging ends angled or sharpened to provide a gripping or holding action on the wires.

3. A terminal connector as in claim 1 wherein the tines are formed integrally with the body and are struck from the body.

4. A terminal connector as in claim 1 wherein said body includes an opening on a side to provide a passage for admitting solder for soldering the lead wires to the body.

5. A terminal connector as in claim 1 wherein wire strips are formed integrally with the body, said strips being struck from the sides of the body and having a converging end which is bent inwardly into the interior of the body to provide a stop for the wires.

* * * * *